US006943782B2

(12) United States Patent
Tamura

(10) Patent No.: US 6,943,782 B2
(45) Date of Patent: Sep. 13, 2005

(54) DISPLAY CONTROL METHOD, DISPLAY CONTROLLER, DISPLAY UNIT AND ELECTRONIC DEVICE

(75) Inventor: Tsuyoshi Tamura, Hara-mura (JP)

(73) Assignee: Seiko Epson Corporation, Tokyo (JP)

( * ) Notice: Subject to any disclaimer, the term of this patent is extended or adjusted under 35 U.S.C. 154(b) by 195 days.

(21) Appl. No.: 09/967,843

(22) Filed: Sep. 28, 2001

(65) Prior Publication Data

US 2002/0047847 A1 Apr. 25, 2002

(30) Foreign Application Priority Data

Sep. 29, 2000 (JP) ..... 2000-299718

(51) Int. Cl.[7] ..... G09G 5/00
(52) U.S. Cl. ..... 345/204; 345/547; 348/220.1
(58) Field of Search ..... 345/87–100, 204, 345/214, 521, 531, 534–558, 60–63, 68, 74.1, 76; 348/220.1, 221.1, 454, 460; 386/109–113, 20–21, 25–26; 382/235, 236, 305–307; 315/167–168, 169.1, 169.4; 313/484, 491, 514, 517, 520

(56) References Cited

U.S. PATENT DOCUMENTS 5,818,411 A * 10/1998 Sakamoto et al. ..... 345/99
5,818,468 A * 10/1998 Le Cornec et al. ..... 345/535
5,896,177 A * 4/1999 Hwang ..... 348/445
5,999,154 A * 12/1999 Yoshioka ..... 345/89
6,310,651 B1 * 10/2001 Mizutome ..... 348/459
6,340,959 B1 * 1/2002 Inamori ..... 345/3.1
6,400,361 B2 * 6/2002 Toffolo ..... 345/213
2002/0011998 A1 * 1/2002 Tamura ..... 345/204

FOREIGN PATENT DOCUMENTS

| | | |
|---|---|---|
| JP | 08-166577 | 6/1996 |
| JP | 09-218666 | 8/1997 |
| JP | 10-511513 | 11/1998 |
| JP | 11-024640 | 1/1999 |
| JP | 11-341495 | 12/1999 |
| JP | 2000-137468 | 5/2000 |
| WO | 96-19078 | 6/1996 |

* cited by examiner

*Primary Examiner*—Bipin Shalwala
*Assistant Examiner*—Mansour M. Said
(74) *Attorney, Agent, or Firm*—Hogan & Hartson, LLP

(57) ABSTRACT

A display controller has a display data RAM, and generates a frame frequency in an internal oscillating circuit. A memory area of the display data RAM corresponds to a moving image display area of a liquid crystal panel. The liquid crystal panel is driven by moving image data read from the display data RAM at the frame frequency. In the display controller, display data generated at a frame frequency lower than the frame frequency from a display data generation circuit is written to the display data RAM. In this case, a control operation is performed such that the display data is read at the frame frequency after a write operation is performed precedently by at least one scanning line.

22 Claims, 9 Drawing Sheets

DISPLAY CONTROL METHOD, DISPLAY CONTROLLER, DISPLAY UNIT AND ELECTRONIC DEVICE

Japanese Patent Application No. 2000-299718, filed Sep. 29, 2000, is hereby incorporated by reference in its entirety.

TECHNICAL FIELD

The present invention relates to a display control method, a display controller, a display unit and an electronic device, and particularly relates to a display control method, a display controller, a display unit and an electronic device suitable for a moving picture display.

BACKGROUND

Various kinds of data with high information property for a user such as a still image, a moving image. etc. can be displayed as well as character letters such as numerals and characters in a display section of an electronic device of a portable type by the development of a communication technique, a mounting technique, etc. in recent years.

With respect to data displayed in such an electronic device, various kinds of data forms are proposed. For example, in the case of a portable telephone, a technique for receiving or transmitting image data compressed and coded by the standard of a Moving Picture Experts Group (MPEG) is proposed.

In this case, for example, a liquid crystal panel is arranged as a display section of the portable telephone, and a received moving or still image is displayed. Namely, for example, in the liquid crystal panel, the received moving image is displayed in a moving image display area, and the still image such as an explanation with respect to this moving image, operating information, etc. is displayed in a still image display area. There is a liquid crystal driver having a RAM utilized as a frame memory as one example of a display controller for displaying and moving the moving image or the still image with respect to such a liquid crystal panel.

In a memory area of the RAM of the liquid crystal driver, it is necessary to rewrite moving image data in real time to a moving image memory area corresponding to the moving image display area of the liquid crystal panel displaying the moving image. In contrast to this, the still image displayed in the still image display area of the liquid crystal panel is changed by a key operation of the portable telephone, etc. Further, it is necessary to rewrite still image data to be updated to a still image memory area corresponding to the still image display area among the memory area of the RAM of the liquid crystal driver.

Display data (moving image data, or still image data) stored to the RAM of such a liquid crystal driver is read every about 1/60 second in consideration of the visual characteristics of a human being, and the liquid crystal panel is driven. Accordingly, for example, when it is necessary to perform extension processing with respect to compression data as in the MPEG standard and no moving image data can be rewritten to the RAM of the liquid crystal driver corresponding to an area to be displayed at this reading rate of 60 Hz, the same image is continuously read over a plurality of frames.

The inventor in the present invention confirmed a visual recognizing property of the liquid crystal panel being driven by such a liquid crystal driver. It has been found from this visual recognizing property that a level able to visually recognize the moving image to a certain extent lies in a range in which the moving image memory area of the RAM of the liquid crystal driver is rewritten by a frame number exceeding about 20 to 25 frames for one second, i.e., a range in which the same image is continuously read by two frames from the RAM of the liquid crystal driver.

In contrast to this, in the case of a range in which the moving image memory area of the RAM of the liquid crystal driver is rewritten by a frame number equal to or smaller than about 20 to 25 frames for one second, i.e., a range in which the same image is continuously read by at least three frames or more from the RAM of the liquid crystal driver, the moving image displayed and moved by the liquid crystal driver has a feeling of physical disorder in connection with the previous frame, etc. Therefore, a technical problem has been found in the display and movement of the moving image in the liquid crystal panel.

SUMMARY

In consideration of the above technical problems, an object of the present invention is to provide a display control method, a display controller, a display unit and an electronic device able to display a moving image having no feeling of physical disorder when a RAM for storing moving image data generated at a rate lower than a reading rate is built in.

A display control method according to one aspect of the present invention is characterized in that the display control method comprises:

a step of preparing a memory which stores display data of at least one frame, a timing generation circuit generating a given display timing, and a display section driven based on the display data from the memory;

a step of sequentially reading the display data for one scanning line from the memory based on the display timing from the timing generation circuit, and displaying images for at least three continuous frames onto the display section, each of the frames including the same image; and a step of writing the display data for one scanning line into the memory at a speed equal to or higher than a reading speed of the display data in synchronization with the display timing prior to the reading of the display data for one scanning line from the memory.

Further, a display controller according to another aspect of the present invention drives a display section based on display data for displaying images for at least three continuous frames, each of which has the same image, and includes:

a timing generation circuit generating a given display timing;

a memory which stores the display data for at least one frame;

a first control circuit which controls reading of the display data for one scanning line stored in the memory based on the display timing to display the display section; and a second control circuit which writes the display data for one scanning line inputted asynchronously with the display timing into the memory at a speed equal to or higher than a reading speed of the display data stored in the memory prior to a read operation.

A display control method according to further aspect of the present invention comprises:

a step of preparing a memory which stores display data of at least one frame, a timing generation circuit generating a given display timing, and a display section driven based on the display data from the memory;

a step of sequentially reading the display data for one scanning line from the memory based on the display timing from the timing generation circuit, and displaying images for at least three continuous frames onto the display section, each of the frames including the same image; and a step of reading the display data for one scanning line for displaying the display section from the memory at a speed equal to or higher than a writing speed of the display data in synchronization with the display timing prior to writing of the display data for one scanning line into the memory in synchronization with the display timing.

A display controller according to still further aspect of the present invention drives a display section based on display data for displaying images for at least three continuous frames, each of which has the same image, and includes:

a timing generation circuit generating a given display timing;

a memory which stores the display data for at least one frame;

a second control circuit writing the display data inputted asynchronously with the display timing into the memory; and a first control circuit which controls reading of the display data for one scanning line stored to the memory at a speed equal to or higher than a writing speed of the display data for one scanning line into the memory prior to a write operation in the write control circuit in order to display the display section.

The present invention is also characterized in that the reading of the first control circuit is performed precedently by at least one scanning line to the writing.

DETAILED DESCRIPTION

Figure 1:
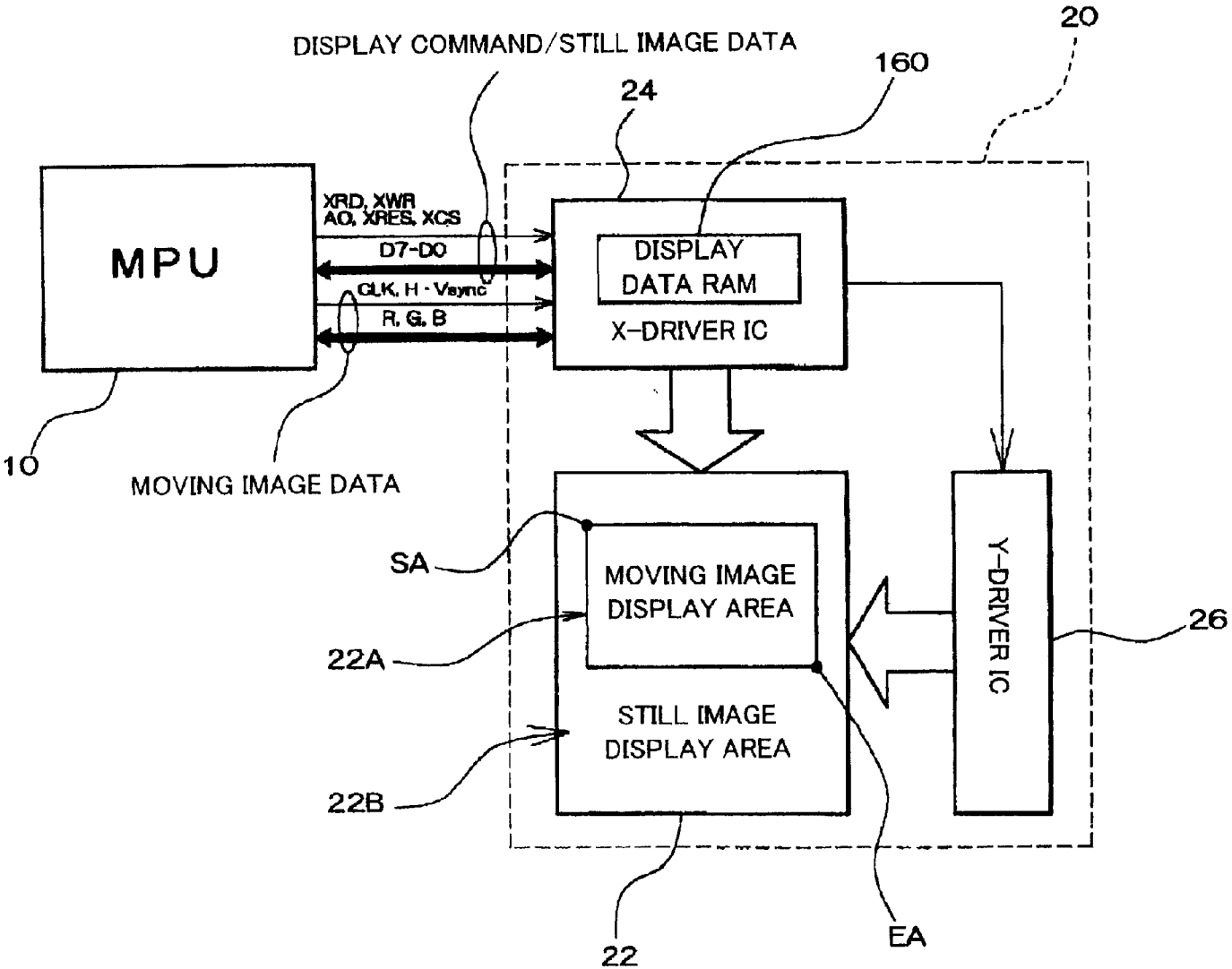
FIG. 1 is a schematic block diagram of an electronic device to which a display controller in an embodiment of the present invention is applied.

A display control method according to one embodiment of the present invention comprises:

a step of preparing a memory which stores display data of at least one frame, a timing generation circuit generating a given display timing, and a display section driven based on the display data from the memory;

a step of sequentially reading the display data for one scanning line from the memory based on the display timing from the timing generation circuit, and displaying images for at least three continuous frames onto the display section, each of the frames including the same image; and a step of writing the display data for one scanning line into the memory at a speed equal to or higher than a reading speed of the display data in synchronization with the display timing prior to the reading of the display data for one scanning line from the memory.

A display controller according to another embodiment of the present invention drives a display section based on display data for displaying images for at least three continuous frames, each of which has the same image, and includes:

a timing generation circuit generating a given display timing;

a memory which stores the display data for at least one frame;

a first control circuit which controls reading of the display data for one scanning line stored in the memory based on the display timing to display the display section; and a second control circuit which writes the display data for one scanning line inputted asynchronously with the display timing into the memory at a speed equal to or higher than a reading speed of the display data stored in the memory prior to a read operation.

In such a method and a device, the timing generation circuit and the memory are arranged, and the display data stored to the memory used as e.g., a frame memory can be read in accordance with the generated display timing. The display section is driven based on the display data read from the memory.

Here, the display data of an image including a same image continuing for three frames or more mean display data when a frame number equal to or smaller than a frame number from 20 frames to about 25 frames for one second is written to the memory when the display data is read from the memory every e.g., 60 frames for one second (in a state of 60 Hz in frame frequency). Namely, since it is necessary to read the display data at the above frame frequency, a plurality of frames or more are continuous and the same frame image is read with respect to the display data stored to the memory.

The display data may include still image data as well as moving image data.

Further, the reading speed is a reading speed of the display data for one scanning line, and is equivalent to a reading rate when the reading speed is equal to a writing speed on one scanning line.

Accordingly, when the display data is written, this write operation is performed prior to the read operation. Further, no write operation to the memory is outrun by the read operation by setting the writing speed on one scanning line to be equal to or higher than the reading speed on one scanning line. Thus, a feeling of physical disorder in connection with the previous frame is removed, and the visual recognizing property of a moving image can be particularly greatly improved when the display section is driven by such a display controller. When the writing speed on one scanning line and the reading speed on one scanning line are equal to each other, similar effects can be obtained by performing the write operation at a frequency equal to or higher than the frame frequency.

In the display control method and device in the one embodiment of the present invention, a write operation of the display data for one scanning line may be performed precedently to a read operation of the display data for one scanning line by at least one scanning line.

Namely, since the display timing is generated by the timing generation circuit, read timing of the scanning line can be also generated and the display data can be easily read in this scanning line unit. Accordingly, the write operation of the display data for one scanning line is precedently performed, and the write operation on one scanning line is performed at a speed equal to or higher than the reading speed on one scanning line. Thus, it becomes easy to perform a control operation in which the write operation of the display data for one scanning line is performed prior to the read operation of the display data for one scanning line at any time.

In the display control method and device in the one embodiment of the present invention, after the display data for one scanning line to be controlled is written, the display data for the one scanning line may be read.

Namely, the preceding concretely means a situation in which the write operation is already performed on the scanning line to be read with respect to the display data when the scanning line of a certain control object is noticed. Accordingly, after the write operation is performed on a certain scanning line within the same frame, the read operation on this scanning line is performed so that a feeling of physical disorder in connection with the previous frame is removed. Thus, the visual recognizing property of a moving image can be particularly greatly improved when the display section is driven by such a display control method.

Further, in the display control method and device in the one embodiment of the present invention, after the display data for one frame is written at a given frame synchronous timing, writing of the display data may be stopped until the next frame synchronous timing (a frame synchronous timing next to the given frame synchronous timing).

Since the writing of the display data is performed prior to the reading and the writing speed on one scanning line is equal to or higher than the reading speed on one scanning line, the writing of the display data of one frame is always terminated before the reading of these display data is terminated. Accordingly, after this termination, control required in the writing such as a write clock, etc. is stopped until the next frame begins to be written. Thus, it is possible to reduce power consumption.

A display control method according to still another embodiment of the present invention comprises:

a step of preparing a memory which stores display data of at least one frame, a timing generation circuit generating a given display timing, and a display section driven based on the display data from the memory;

a step of sequentially reading the display data for one scanning line from the memory based on the display timing from the timing generation circuit, and displaying images for at least three continuous frames onto the display section, each of the frames including the same image; and a step of reading the display data for one scanning line for displaying the display section from the memory at a speed equal to or higher than a writing speed of the display data in synchronization with the display timing prior to writing of the display data for one scanning line into the memory in synchronization with the display timing.

A display controller according to still another embodiment of the present invention drives a display section based on display data for displaying images for at least three continuous frames, each of which has the same image, and includes:

a timing generation circuit generating a given display timing;

a memory which stores the display data for at least one frame;

a second control circuit writing the display data inputted asynchronously with the display timing into the memory; and a first control circuit which controls reading of the display data for one scanning line stored to the memory at a speed equal to or higher than a writing speed of the display data for one scanning line into the memory prior to a write operation in the write control circuit in order to display the display section.

Thus, when the display data is written, the reading of the display data is performed prior to the writing, and the reading speed on one scanning line is set to be equal to or higher than the writing speed on one scanning line so that no reading from the memory is outrun by the writing. Thus, a feeling of physical disorder in connection with the previous frame is removed. Accordingly, the visual recognizing property of a moving image can be particularly greatly improved when the display section is driven by such a display control method. When the writing speed on one scanning line and the reading speed on one scanning line are equal to each other, similar effects can be obtained by performing the write operation at a frequency equal to or higher than the frame frequency.

In display control method and device of the still another embodiment of the present invention, a read operation of the display data for one scanning line may be performed precedently by at least one scanning line to a write operation of the display data for one scanning line.

Namely, since the display timing is generated by the timing generation circuit, the timing of a reading scanning line can be also generated, and the display data can be easily read in this scanning line unit. Accordingly, the read operation of the display data for one scanning line is precedently performed, and the read operation is performed at a speed equal to or higher than the writing speed on one scanning line. Thus, it becomes easy to perform a control operation in which the read operation on one scanning line is performed prior to the write operation on one scanning line at any time.

In the display control method and device of the still another embodiment of the present invention, after the display data for one scanning line to be controlled is read, the display data for the one scanning line may be written.

Here, the preceding concretely means a situation in which the read operation is already performed on the scanning line to be written with respect to the display data when the scanning line of a certain control object is noticed. Accordingly, after the read operation is performed on a certain scanning line within the same frame, the write operation on this scanning line is performed so that a feeling of physical disorder in connection with the previous frame is removed. Thus, the visual recognizing property of a moving image can be particularly greatly improved when the display section is driven by such a display control method.

In the display control method and device in each of the embodiments of the present invention, the display data written into the memory may be inputted in synchronization with display timing generated by the display controller.

Thus, for example, even when the display data to be written to the built-in memory is generated asynchronously with the display timing, the display data such as moving image data important in connection with the previous frame is easily supplied by simple control.

In each of the various kinds of embodiments of the present invention, a circuit for outputting the display timing can be included.

The display timing is outputted from the display controller in this way. Accordingly, for example, even when the display data to be written to the built-in memory is generated asynchronously with the display timing, the display data such as moving image data important in connection with the previous frame is easily supplied by simple control.

In still another embodiment of the present invention, a display unit and an electronic device can be constructed by including the display controller.

Preferred embodiments of the present invention will next be explained in more detail by using the drawings.

1. An Electronic Device to Which the Display Controller of this Embodiment is Applied FIG. 1 shows a schematic block diagram of an electronic device to which the display controller of this embodiment is applied.

This electronic device includes an MPU (microprocessor unit) 10 and a display unit 20.

The display unit 20 has a matrix panel having an electro-optic element, e.g., a color liquid crystal panel 22, an X-driver IC (display controller) 24 having a RAM (a memory in a wide sense) operating this liquid crystal panel 22, and a Y-driver IC 26 for scanning.

The matrix panel 22 may be constructed by using a liquid crystal having optical characteristics changed by voltage application, and other electro-optic elements. The liquid crystal panel 22 can be constructed by e.g., a simple matrix panel. In this case, a liquid crystal is sealed between a first substrate forming a plurality of segment electrodes (first electrodes) thereon and a second substrate forming a common electrode (second electrode) thereon. The liquid crystal panel 22 may be also constructed by an active matrix panel using a three-terminal element and a two-terminal element such as a thin film transistor (TFT), a thin film diode (TFD), etc. These active matrix panels also have a plurality of signal electrodes (first electrodes) operated by the X-driver IC 24 having a built-in RAM, and a plurality of scanning electrodes (second electrodes) scanned by the Y-driver IC 26.

In the liquid crystal panel 22, a still image and a moving image can be simultaneously displayed. In this case, as shown in FIG. 1, a moving image display area 22A determined by an image size and a still image display area (text data display area) 22B except for the moving image display area 22A are respectively set in the liquid crystal panel.

As shown in FIG. 1, display command/still image data and moving image data are mainly supplied from the MPU 10 to the display unit 20. The display command is typically constructed by a signal A0 showing the discrimination of command/data, an inversion reset signal XRES, an inversion chip select signal XCS, an inversion read signal XRD, an inversion write signal XWR, etc. Data D7 to D0 are command data (including address data for a still image and a moving image) or still image data of 8 bits, and are discriminated from each other by logic of the command/data identification signal A0. The moving image data is constructed by e.g., R, G and B signals each having 6 bits, and a clock signal CLK, a horizontal synchronous signal Hsync, a vertical synchronous signal Vsync, etc. is also supplied.

Figure 2:
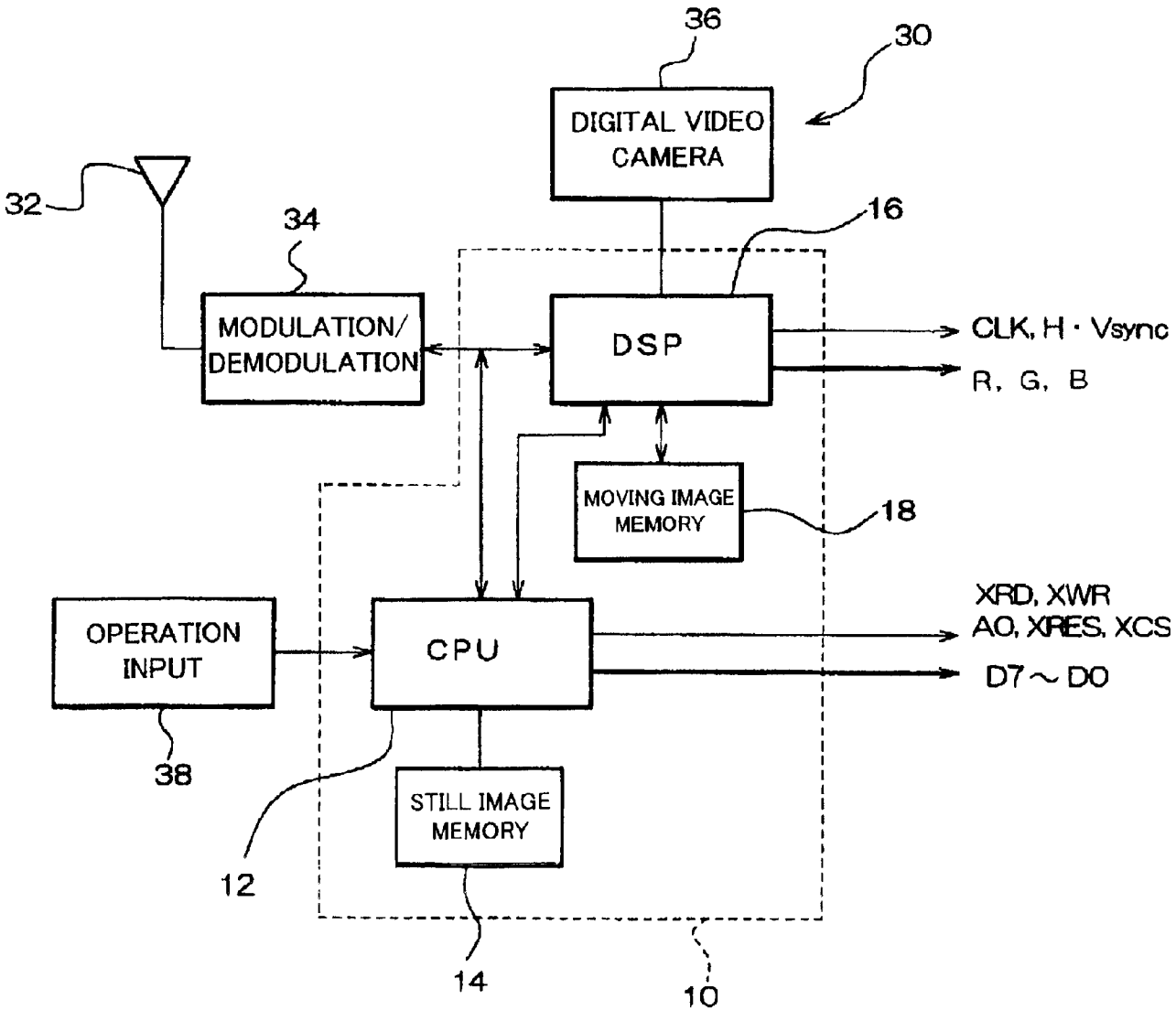
FIG. 2 is a schematic block diagram of a portable telephone as one example of the electronic device to which the display controller in this embodiment is applied.

FIG. 2 shows an example in which the MPU 10 and the display unit 20 of FIG. 1 are mounted to a portable telephone 30. The MPU 10 shown in FIG. 2 has a CPU 12 for controlling an operation of the portable telephone 30. A still image memory 14 and a digital signal processor (DSP) 16 are connected to this CPU 12. A moving image memory 18*a* is connected to the DSP 16.

A modulation/demodulation circuit 34 for demodulating a signal received through an antenna 32, or modulating a signal transmitted through the antenna 32 is arranged in this portable telephone 30. Moving image data coded by e.g., the standard of a layer IV of the MPEG can be transmitted and received from the antenna 32.

For example, a digital video camera 36 can be also arranged in this portable telephone 30. The moving image data can be inputted through this digital video camera 36. operation information required to transmit and receive data in the portable telephone 30 and take a photograph in the digital video camera 36, etc. is inputted through an operation input section 38.

The CPU 12 arranged in the MPU 10 determines a size of the moving image from moving image information when the moving image is displayed in the moving image display area 22A of the liquid crystal panel 22. Namely, the CPU 12 determines a start address SA and an end address EA of the moving image shown in FIG. 1. For example, the moving image display area 22A and the still image display area 22B may be line-divided vertically. In this case, the start address SA and the end address EA are similarly determined from the size of the moving image.

The moving image displayed in this moving image display area 22A is supplied from the antenna 32 or the digital video camera 36 in this embodiment. A signal inputted from the antenna 32 is demodulated through the modulation/demodulation circuit 34, and is processed by the DSP 16. This DSP 16 is connected to the moving image memory 18 the, and extends compressed data inputted through the antenna 32 and the modulation/demodulation circuit 34. Further, the DSP 16 decodes data coded by the standard of the layer IV of the MPEG. Data transmitted through the modulation/demodulation circuit 34 and the antenna 32 are compressed by the DSP 16, and is encoded when the data is coded and transmitted by the standard of the layer IV of the MPEG. Thus, the DSP 16 can function as a decoder and an encoder of e.g., the layer IV of the MPEG.

A signal from the digital video camera 36 is also inputted to this DSP 16, and a signal inputted from the antenna 32 or the digital video camera 36 is processed and converted to an RGB signal by the DSP 16, and is supplied to the display unit 20.

The CPU 12 outputs commands and still image data required to display the still image displayed in the liquid crystal panel 22 to the display unit 20 by using the still image memory 14 in accordance with necessity based on information from the operation input section 38, etc.

For example, the moving image is movie information distributed via the Internet, and information for preengaging its theater ticket is displayed as the still image. The ticket preengagement is executed based on information from the operation input section 38. Therefore, the CPU 12 further controls transmission of the still image information (e.g., preengaging information) through the modulation/demodulation circuit 34 and the antenna 32. Further, the CPU 12 can control the transmission of moving image information photographed by the digital video camera 36 through the modulation/demodulation circuit 34 and the antenna 32 in accordance with necessity.

2. Features of the Display Controller of this Embodiment

The display controller (the X-driver IC 24 in FIG. 1 in a narrow sense) of this embodiment has a RAM (a memory in a wide sense) having an image memory area corresponding to an image display area of the liquid crystal panel, and generates a frame frequency of e.g., 60 Hz as display timing for performing a display operation of the liquid crystal panel by an internal oscillating circuit (a display timing generating means in a wide sense).

Since the RAM and the oscillating circuit having a highest frequency are built in, power consumption can be reduced when the display controller is mounted onto a substrate of the liquid crystal panel.

Further, the display controller of this embodiment writes display data for one scanning line of images for at least three continuous frames, each of which including the same image, at a speed equal to or higher than a reading speed of display data for one scanning line already stored to the RAM in the above display timing, and this write operation is performed prior to a read operation.

Figure 3:
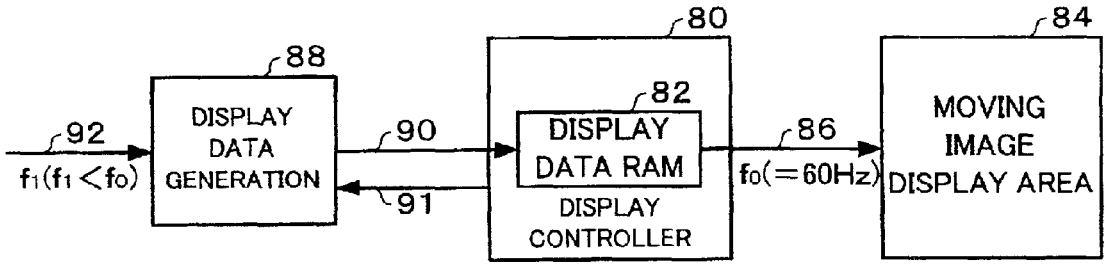
FIG. 3 is an explanatory view for explaining an operating principle of the display controller in this embodiment.

FIG. 3 shows an explanatory view for explaining a principle operation of the display controller of this embodiment. Here, FIG. 3 shows a case in which moving image data displayed and processed at a frame frequency of 60 Hz is noticed as the display data, but still image data may be also noticed.

A display controller 80 in this embodiment has a display data RAM 82 for storing display data of at least one frame, and generates a frame frequency of $f_0$ (e.g., $f_0$=60 Hz) by an unillustrated internal oscillating circuit. At least one portion of a memory area of the display data RAM 82 corresponds to a moving image display area 84 of the liquid crystal panel. The display controller 80 reads moving image data 86 stored to the display data RAM 82 at this generated frame frequency $f_0$, and drives the liquid crystal panel so that a moving image is displayed in this moving image display area 84.

Moving image data 90 supplied from a display data generation circuit 88 is written to the display data RAM 82 of the display controller 80. The display data generation circuit 88 generates moving image data 90 by extending compressed data 92 of the moving image at a frame frequency $f_1$ ($f_1<f_0$) lower than the frame frequency $f_0$ such as about 15 frames for one second in e.g., the MPEG-4 standard.

The display controller 80 reads the moving image data at the frame frequency $f_0$ irrespective of stored contents of the display data RAM 82. Accordingly, when the display data generation circuit 88 must write the moving image data to the display data RAM 82 at the frequency $f_1$ lower than the frame frequency $f_0$ by the above extension processing, etc., the display controller 80 reads the moving image data of the same image over a plurality of continuous frames from the display data RAM 82, and displays e.g., the moving image by driving the liquid crystal panel.

Therefore, the display controller 80 of this embodiment outputs a vertical synchronous signal 91 for display to the display data generation circuit 88 with the frame frequency $f_0$ as a frame synchronous signal for display. The display data generation circuit 88 outputs the generated moving image data 90 to the display controller 80 in synchronization with this vertical synchronous signal 91 for display. When the moving image data including a same image continuing for three frames or more is written to the display data RAM 82 in the display controller 80, a control operation is performed such that the write operation is precedently performed on at least one scanning line or more with this vertical synchronous signal 91 for display as a starting point, and the moving image data is then read from the display data RAM 82 at the frame frequency $f_0$. Thus, no moving image displayed in the liquid crystal panel has a feeling of physical disorder e.g., in connection with the previous frame so that visual recognizing property can be greatly improved.

Figure 4A:
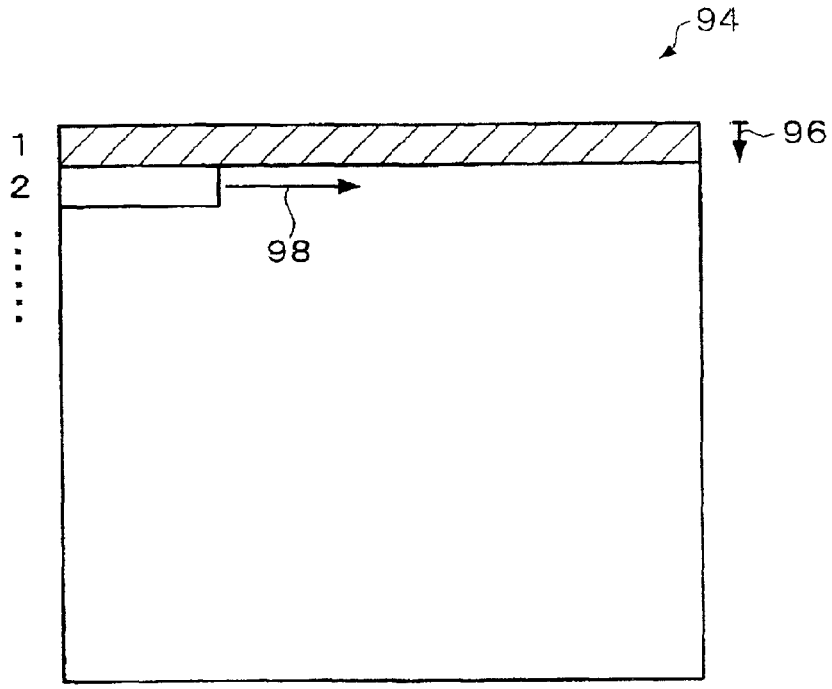
FIGS. 4A and 4B are explanatory views typically showing the relation of a writing position and a read position in the display controller of this embodiment.
Figure 4B:
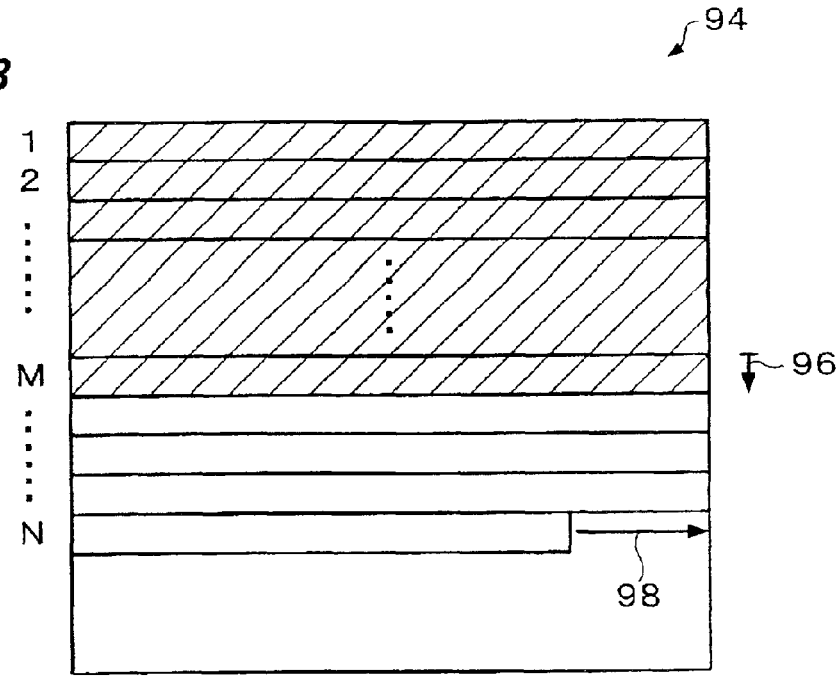

FIGS. 4A and 4B typically show the relation of write timing and read timing of the display data RAM in the display controller of this embodiment. Here, the memory area of the display data RAM is typically shown in a scanning line unit of the moving image display area of the liquid crystal panel.

FIG. 4A shows the relation of a write position and a read position of the moving image data when the moving image data on a first scanning line of a moving image display area 94 is written to the memory area of the display data RAM corresponding to the moving image display area 94. Namely, as shown in FIG. 4A, after the write operation on the first scanning line in the moving image display area 94 is performed, a read operation 96 on this first scanning line is performed. Accordingly, when the read operation 96 on the first scanning line is performed, a write operation 98 on a second scanning line is already performed.

In this embodiment, the relation of the following formula (1) is formed between a reading speed $V_R$ of the read operation 96 of display data for one scanning line of display and a writing speed $V_W$ of the write operation 98 of the display data for one scanning line.

$$V_W \geqq V_R \tag{1}$$

Accordingly, as long as the write operation 98 is performed prior to the read operation 96, no reading of the moving image data for driving the liquid crystal panel outruns the writing of new moving image data to the moving image display area 94. Thus, a feeling of physical disorder in connection of the previous frame is dissolved, and a moving image smoothly moved can be displayed.

FIG. 4B shows the relation of a write position and a read position of the moving image data when the moving image data on an M-th scanning line of the moving image display area 94 is written to the memory area of the display data RAM corresponding to the moving image display area 94. When the moving image data on the M-th scanning line (M is a natural number) is read, the write operation on an N-th scanning line (M<N, and N is a natural number) is already performed from the formula (1).

Here, when the reading speed $V_R$ of the read operation 96 of display data for one scanning line of display and the writing speed $V_W$ of the write operation 98 of the display data for one scanning line are equal to each other, the relation of a reading rate $f_R$ and a writing rate $f_W$ is prescribed as in the following formula (2).

$$f_W \geqq f_R \tag{2}$$

In the case of FIG. 3, the reading rate $f_R$ corresponds to the frame frequency $f_0$ (=60 Hz). Accordingly, in this case, the write operation must be performed at a rate equal to or greater than 60 Hz.

3. Construction of the Display Controller of this Embodiment

Figure 5:
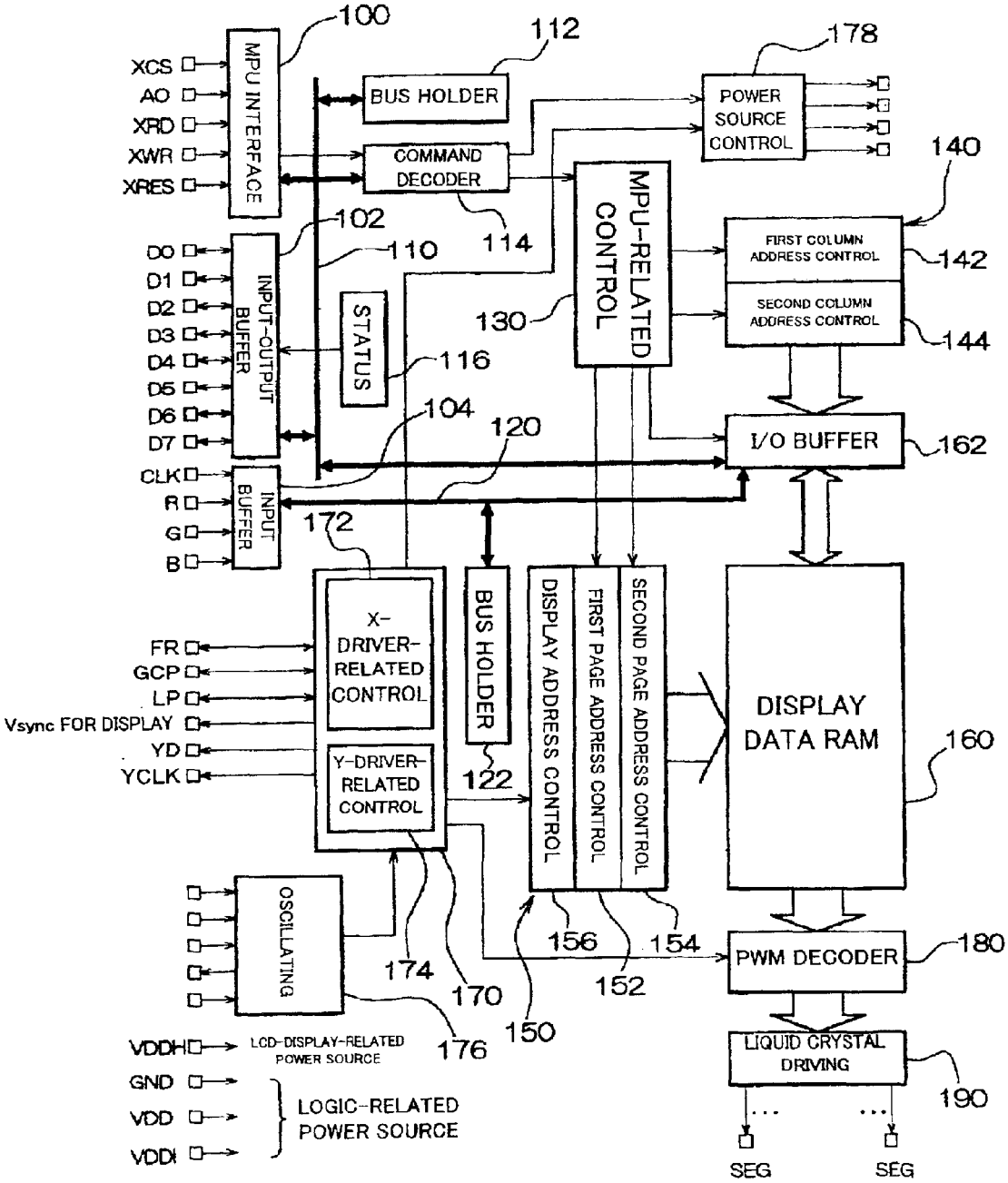
FIG. 5 is a schematic block diagram of an X-driver IC as the display controller of this embodiment.

FIG. 5 is a block diagram of the X-driver IC 24 having a built-in RAM shown in FIG. 1 as the display controller of this embodiment. An MPU interface 100, an input-output buffer 102 and an input buffer 104 are arranged as an input-output circuit of the X-driver IC 24 having the built-in RAM shown in FIG. 5.

An inversion chip select signal XCS, an identification signal A0 of commands/data, an inversion read signal XRD, an inversion write signal XWR, an inversion reset signal XRES, etc. are inputted to the MPU interface 100.

For example, commands or still image data D7 to D0 of 8 bits are inputted to the input-output buffer 102. FIG. 5 shows an example in which the signals D7 to D0 are inputted and outputted in parallel with each other. However, when it is not necessary to read data from a display data RAM 160 within the X-driver IC 24 to the MPU 10, a leading bit may be set to the identification signal A0, and subsequent signals D7 to D0 may be serially inputted and outputted. In this case, the number of terminals of the MPU 10 and the X-driver IC 24 can be reduced.

For example, moving image data constructed by R, G, B signals each having 6 bits, and a clock signal CLK are inputted to the input buffer 104. The R, G, B signals each having 6 bits are inputted and outputted in parallel with each other in synchronization with the clock signal CLK.

A first bus line 110 connected to the MPU interface 100 and the input-output buffer 102, and a second bus line 120 connected to the input buffer 104 are arranged in the X-driver IC 24.

A bus holder 112 and a command decoder 114 are connected to the first bus line 110, and a bus holder 122 is connected to the second bus line 120. A status setting circuit 116 is connected to the input-output buffer 102 so that an operating state of the X-driver IC 24 is outputted to the MPU 10. For example, this operating state is an internal state set in the X-driver IC 24 such as a state as to whether the display is a turning-on state or not, or a scroll mode in a given scroll area within the screen. A given command inputted from the MPU 10 is decoded in the command decoder 114 so that this command is outputted.

Both the first bus line 110 and the second bus line 120 are connected to an I/O buffer 162 of the display data RAM 160, and read and written still image data and moving image data are transmitted to the display data RAM 160.

An MPU-related control circuit 130, a column address control circuit 140, a page address control circuit 150, a driver-related control circuit 170, a PMW decoder circuit 180, a liquid crystal driving circuit 190, etc. are arranged in the X-driver IC 24 in addition to the above display data RAM 160 and the I/O buffer 162.

The MPU-related control circuit 130 controls read and write operations with respect to the display data RAM 160 based on commands of the MPU 10 inputted through the command decoder 114. The column address control circuit 140 and the page address control circuit 150 controlled by this MPU-related control circuit 130 are arranged. In this embodiment, the column address control circuit 140 has a first column address control circuit 142 for designating a write column address of still image data and read column addresses of the static and moving image data, and a second column address control circuit 144 for designating a write column address of the moving image data. The page address control circuit 150 has a first page address control circuit 152 for designating a write page address of the still image data and read page addresses of the static and moving image data, and a second page address control circuit 154 for designating a write page address of the moving image data. A horizontal-vertical synchronous signal H Vsync from the MPU 10 is inputted to the MPU-related control circuit 130 although this signal is not shown in FIG. 5. The horizontal synchronous signal Hsync is used to set and reset counters arranged within the second column page address control circuits 144, 154 to restrain a display shift due to a writing error caused by noises, etc. in writing of the moving image data as much as possible. Further, the horizontal-vertical synchronous signal H Vsync is used to return a column address and a page address to a start address SA. The page address control circuit 150 includes a display address control circuit 156 controlled by the driver-related control circuit 170 and designating a display address every one scanning line.

The driver-related control circuit 170 includes an X-driver-related control circuit 172 and a Y-driver-related control circuit 174. This driver-related control circuit 170 generates a vertical synchronous signal Vsync for display, a gradation control pulse GCP, a polarity inversion signal FR, a latch pulse LP for scanning, a start pulse YD for a Y-driver, a scanning clock YCLK for the Y-driver, a write clock to the display data RAM 160, etc. based on an oscillating output from an oscillating circuit 176. The driver-related control circuit 170 controls operations of the display address control circuit 156, the PWM decode circuit 180, a power source control circuit 178 and a Y-driver IC 26 independently of the MPU-related control circuit 130.

The driver-related control circuit 170 of this embodiment externally outputs the vertical synchronous signal Vsync for display generated based on the oscillating output from the oscillating circuit 176. An unillustrated display data generation circuit supplies generated moving image data to the X-driver IC 24 having the built-in RAM as the display controller of this embodiment in synchronization with this vertical synchronous signal Vsync for display.

The driver-related control circuit 170 writes the moving image data supplied in accordance with this vertical synchronous signal Vsync for display to the data RAM 160 for display as an image of a new frame every one scanning line in synchronization with a write clock generated based on the oscillating output from the oscillating circuit 176.

Further, the driver-related control circuit 170 reads an image of one frame from the data RAM 160 for display every one scanning line in a state in which a latch pulse LP for scanning generated based on the oscillating output from the oscillating circuit 176 is set to a reference. This read operation is performed after the write operation on at least one scanning line is performed. Further, in this read operation, a writing speed of display data for one scanning line to the display data RAM 160 is set to be equal to or higher than a reading speed of the display data for one scanning line of display from the display data RAM 160.

The PWM decode circuit 180 latches data read from the display data RAM 160 every one scanning line, and outputs a signal of a pulse width according to a gradation value in accordance with a polarity inversion period. The liquid crystal driving circuit 190 shifts the signal from the PWM decode circuit 180 to a voltage according to the voltage of an LCD display-related system, and supplies this signal to a segment electrode SEG of the liquid crystal panel 20 shown in FIG. 1.

3.1 Display Data RAM and its Peripheral Circuit

Figure 6:
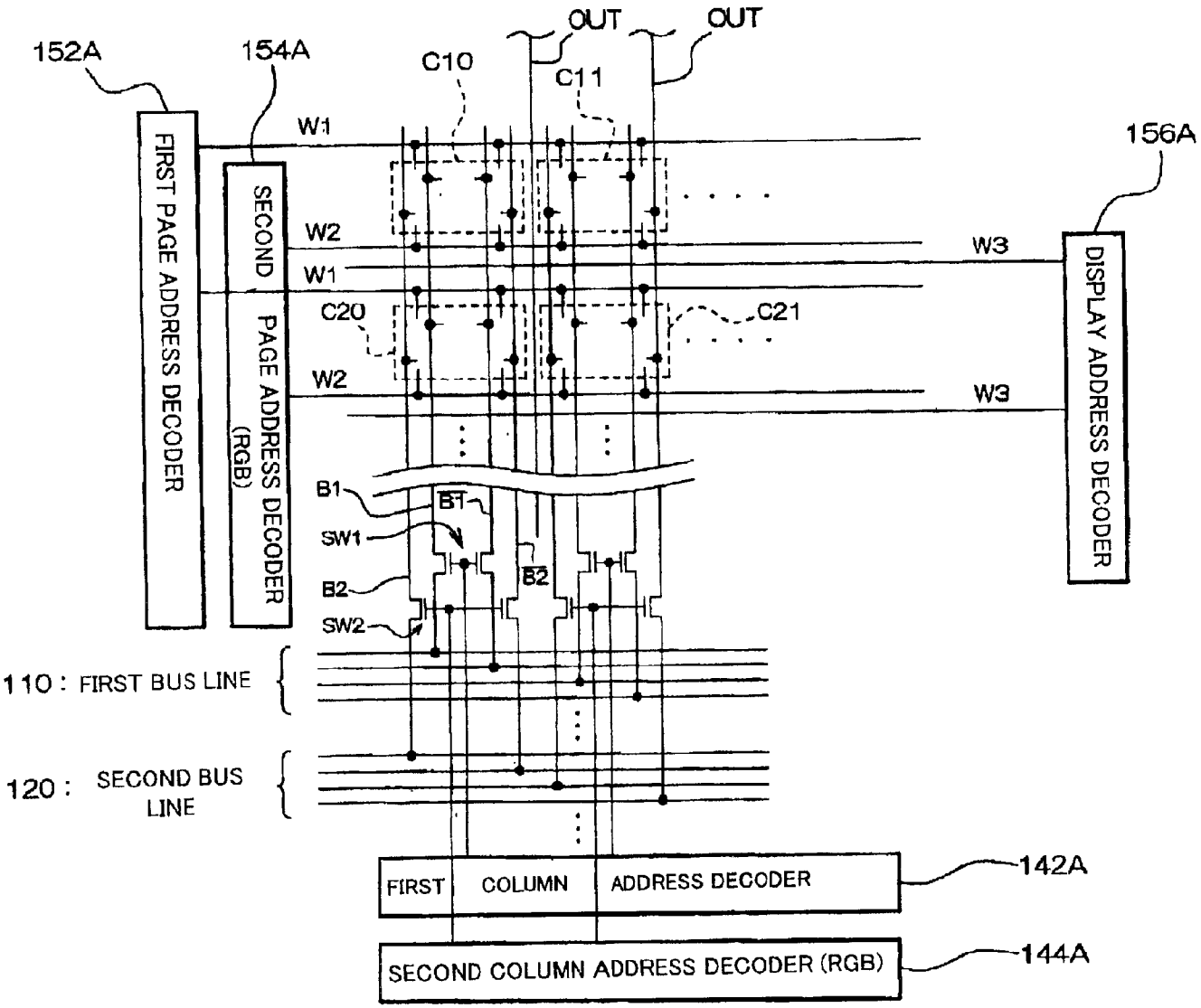
FIG. 6 is a schematic explanatory view of a display data RAM and its peripheral circuit in this embodiment.

FIG. 6 shows a schematic circuit diagram of the display data RAM 160 and its peripheral circuit. FIG. 6 shows first and second column address decoders 142A, 144A, first and second page address decoders 152A, 154A and a display address decoder 156A arranged at respective final stages of the first and second column address control circuits 142, 144, the first and second page address control circuits 152, 154, and the display address control circuit 156.

FIG. 6 further shows memory cells C10, C11, - - - , C20, C21, - - - on first and second lines. First to third word lines W1 to W3, a first bit line pair B1, /B1 and a second bit line pair B2, /B2 are connected to each memory cell shown in FIG. 6.

The first column address decoder 142A outputs a signal for turning on and off a first column switch SW1 connected to the first bit line pair B1, /B1. The second column address decoder 144A outputs a signal for turning on and off a second column switch SW2 connected to the second bit line pair B2, /B2. The first page address decoder 152A supplies a signal for setting the first word line W1 to be active. The second page address decoder 154A supplies a signal for setting the second word line W2 to be active. The display address decoder 156A supplies a signal for setting the third word line W3 to be active.

The second column and page address decoders 144A, 154A are used only when column and page addresses for write moving image data (R, G, B) are designated. The moving image data (R, G, B) is written by this address designation to a memory cell through the second bus line 120 and the second column switch SW2.

The first column and page address decoders 142A, 152A designate column and page addresses when still image data is written and the static and moving image data are read. Data is read and written by this address designation with respect to the display data RAM 160 through the first bus line 110 and the first column switch SW1.

The display address decoder 156A reads data of all memory cells on one scanning line to a display data output line OUT by sequentially setting the third word line W3 to be active one by one. The read data is supplied to the PWM decoder circuit 180 shown in FIG. 5 and are used to operate a liquid crystal.

3.2 Construction of Memory Cell

Figure 7:
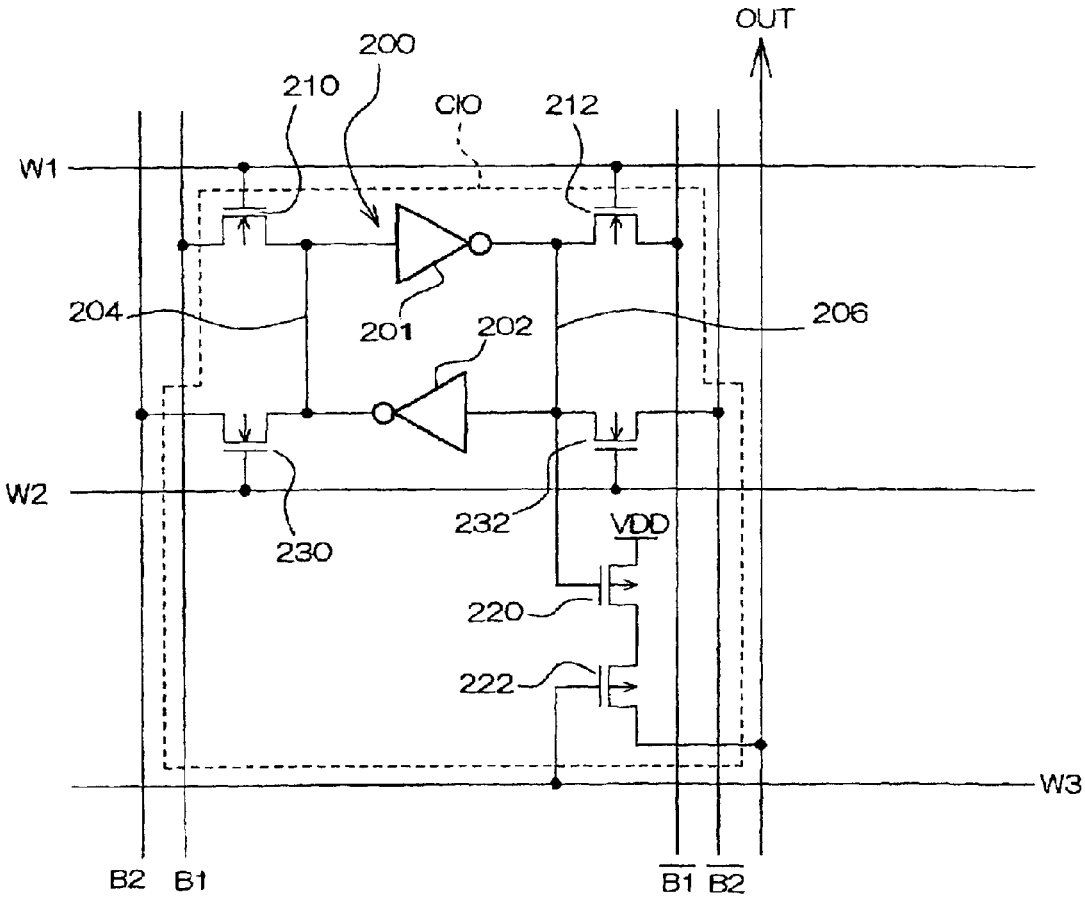
FIG. 7 is a view showing the construction of a memory cell within the display data RAM of this embodiment.

FIG. 7 illustrates a circuit diagram showing the memory cell C10 within the display data RAM 160. The memory cell C10 has the same construction as the other memory cells. This memory cell C10 has a memory element 200 constructed by two CMOS inverters 210, 202. The two MOS inverters 201, 202 have first and second wirings 204, 206 for connecting inputs and outputs of these MOS inverters to each other. A first N-type MOS transistor 210 (first switch) is connected between the first wiring 204 and the bit line B1, and its gate is connected to the first word line W1. Similarly, a second N-type MOS transistor 212 (first switch) is connected between the second wiring 206 and the bit line /B1, and its gate is connected to the first word line W1.

In the above construction, when the first word line W1 attains a logic level "H" (hereinafter, simply abbreviated as H) by an active signal from the first page address decoder 152A, the first and second N-type transistors 210, 212 are turned on. Thus, the memory cell C10 is connected to the first pair of bit lines B1, /B1. At this time, when the first column switch SW1 is turned on by the active signal from the first column address decoder 142A, data with respect to the memory cell C10 can be read and written.

First and second P-type MOS transistors 220, 222 are connected between a power supply line VDD and the display data output line OUT. A gate of the first P-type MOS transistor 220 is connected to the second wiring 206, and a gate of the second P-type MOS transistor 222 is connected to the third word line W3.

Before data of the memory cell C10 is read to the display data output line OUT, this display data output line OUT is precharged to a logic level "L" (hereinafter, simply abbreviated as L). After this precharge operation, data of the display data output line OUT is latched by the PWM decoder circuit 180 in a state in which the third word line W3 is set to L and the second P-type MOS transistor 222 is turned on. At this time, when an electric potential of the second wiring 206 is H (an electric potential of the first wiring 204 is L), the display data output line OUT is L as it is. In contrast to this, when the electric potential of the second wiring 206 is L (the electric potential of the first wiring 204 is H), the display data output line OUT becomes H. Thus, display data from the display data RAM 160 can be simultaneously read on one scanning line.

In this embodiment, the second word line W2 and the second bit line pair B2, /B2 are further arranged. Therefore, a third N-type MOS transistor 230 (second switch) is connected between the first wiring 204 and the bit line B2, and its gate is connected to the second word line W2. Similarly, a fourth N-type MOS transistor 232 (second switch) is connected between the second wiring 206 and the bit line /B2, and its gate is connected to the second word line W2.

In the above construction, when the second word line W2 becomes H by an active signal from the second page address decoder 154A, the third and fourth N-type transistors 230, 232 are turned on, and the memory cell C10 is connected to the second pair of bit lines B2, /B2. At this time, when the second column switch SW2 is turned on by the active signal from the second column address decoder 144A, moving image data with respect to the memory cell C10 can be written.

4. Operation Timing of Display Controller of this Embodiment

The MPU 10 knows and obtains a page address and a column address of the display data RAM 160 corresponding to start and end addresses SA, EA of the moving image display area 22A shown in FIG. 1 from moving image information in advance. Therefore, the MPU 10 can repeatedly designate the column address and the page address of an area corresponding to the moving image display area 22A among an area of the display data RAM 160 in accordance with a given writing frequency. The column address and the page address of the area corresponding to this moving image display area 22A are inputted to the second column address control circuit 144 and the second page address control circuit 154 via the input-output buffer 102 of the X-driver IC 24 and the MPU-related control circuit 130. Finally, column and page addresses of the display data RAM 160 are designated through the second column address decoder 144A and the second page address decoder 154A shown in FIG. 6. The moving image data can be transmitted in real time in a path different from the bus line 110 of still image data by transmitting the moving image data via the input buffer 104 and the second bus line 120. Thus, the moving image data can be rewritten in real time.

On the other hand, the MPU 10 designates a column address and a page address of an area corresponding to the still image display area 22A among the area of the display data RAM 160, and executes data rewriting at a given writing frequency only when the still image data is changed such as when there is an information input from the operation input section 38, etc.

Thus, in this embodiment, the address designation and the data transmission are respectively executed in separate routes when the still image and the moving image are written to the display data RAM 160. The memory cell is constructed such that data of each of the static and moving images can be written to the memory cell. Accordingly, the still image and the moving image can be simultaneously written to different memory cells in a page unit, and it is not necessary to stop data writing of one of the static and moving images.

Further, since the memory cell is constructed such that the data of each of the still image and the moving image is written to the memory cell, the moving image display area 22A can be arbitrarily changed.

Here, when the moving image is displayed in the moving image display area 22A of the liquid crystal panel 22, display data is read from the display data RAM 160 in accordance with display timing able to display frames e.g., at 60 Hz, i.e., display 60 frames for one second. In contrast to this, write timing to the display data RAM 160 is set prior to its read timing as mentioned above, and a writing speed of the display data for one scanning line is set to be equal to or higher than a reading speed of the display data for one scanning line.

Figure 8:
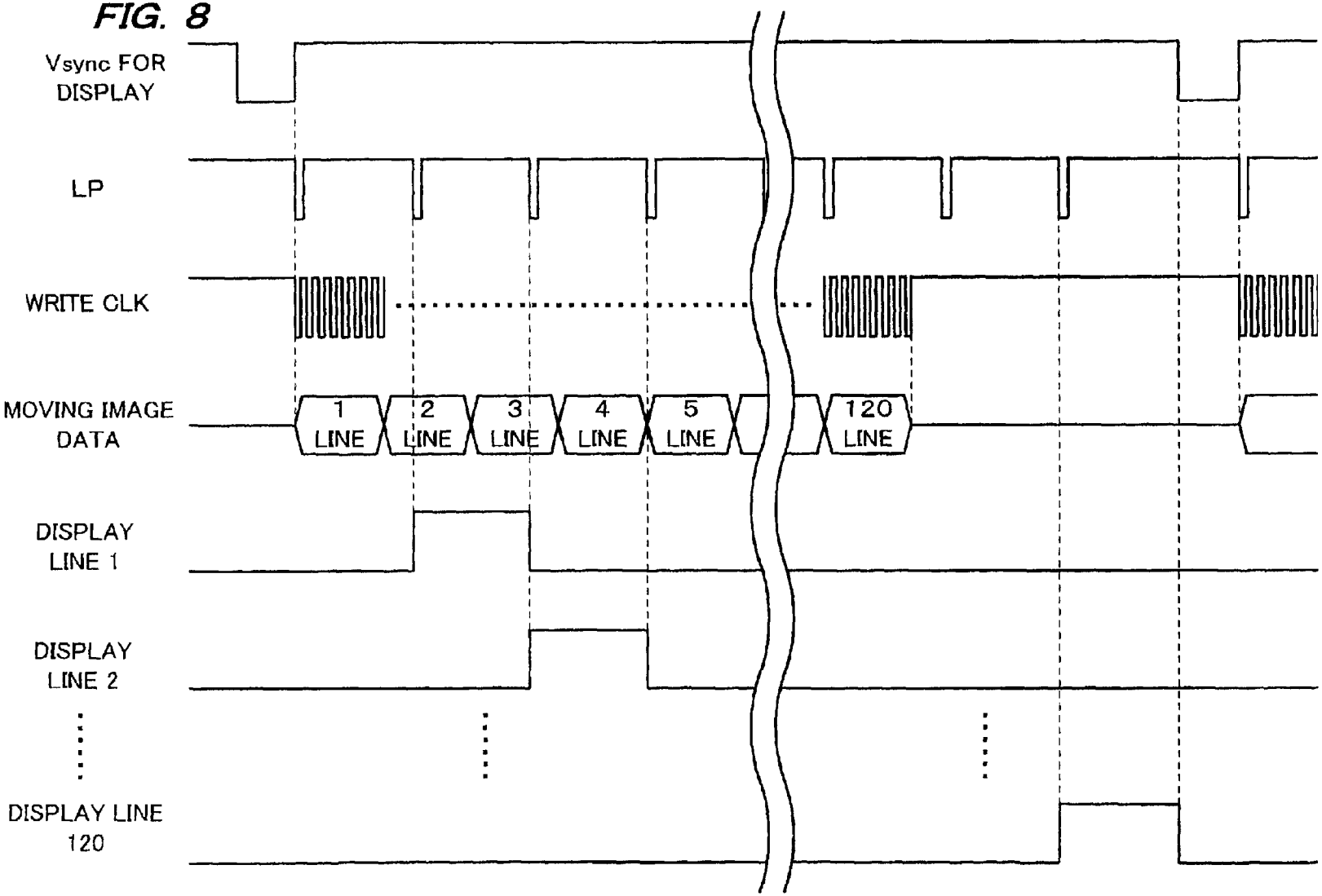
FIG. 8 is a timing chart showing write timing and read timing of moving image data in the display controller in this embodiment.

FIG. 8 shows the write timing of moving image data in the display controller of this embodiment.

Namely, the output of a write clock (CLK) is started in a state in which an edge of the vertical synchronous signal Vsync for display generated in one frame unit based on an internally generated oscillating output of the oscillating circuit is set to a reference. The moving image data of one frame is sequentially written to a moving image memory area corresponding to the moving image display area 22A set in the display data RAM 160 every one scanning line.

On the other hand, the output of a latch pulse LP for scanning is started with the edge of the vertical synchronous signal Vsync for display as a reference. However, a read operation is sequentially performed from the moving image memory area corresponding to the moving image display area 22A set in the display data RAM 160 in synchronization with a second latch pulse delayed by one scanning line with respect to the vertical synchronous signal Vsync for display as a frame synchronous signal. Namely, after the write operation is precedently performed by one scanning line, the read operation is performed.

For example, when a size of the moving image memory area corresponding to the moving image display area 22A set in the display data RAM 160 is set to 120 scanning lines, a write clock is fixedly set to H when the write operation on the 120 scanning lines is terminated. Thus, the operation of the write clock is stopped.

Thereafter, when the moving image data is written to the display data RAM 160, the display data RAM 160 is accessed in a similar relation with respect to the write timing and the read timing every one frame.

5. Modified Example

The display controller in this embodiment writes the display data to the built-in display data RAM precedently by at least one scanning line, and then reads the display data. However, the present invention is not limited to this case. The display controller in this modified example reads the display data from the built-in display data RAM precedently by one scanning line, and then writes the display data of a subsequent one frame.

The display controller in this modified example has a construction similar to that of the display controller in this embodiment. Therefore, an explanation of this display controller is omitted.

In this modified example, the relation of the following formula (3) is formed between a reading speed $V_R'$ of the display data for one scanning line of display and a writing speed $V_w'$ of the display data for one scanning line.

$$V_R' \geqq V_W' > V_{R0} \quad (3)$$

Here, $V_{R0}$ shows a minimum value of the reading speed at which the display data on a first scanning line of the next frame begin to be read when it is further delayed. In this case, when the writing speed $V_W'$ of the display data for one scanning line is equal to or lower than the reading speed $V_{R0}$ of the display data for one scanning line, reading of the display data of the next frame is started, and there is a possibility that a feeling of physical disorder is left in visual recognizing property of a moving image displayed in the liquid crystal panel.

However, as long as the read operation is performed prior to the write operation and the writing speed of the display data for one scanning line has the relation of the formula (3), no write operation of new moving image data in the moving image display area outruns the read operation of the moving image data of a frame for driving the liquid crystal panel. In this case, it is also possible to dissolve the feeling of physical disorder in connection with the previous frame.

Figure 9:
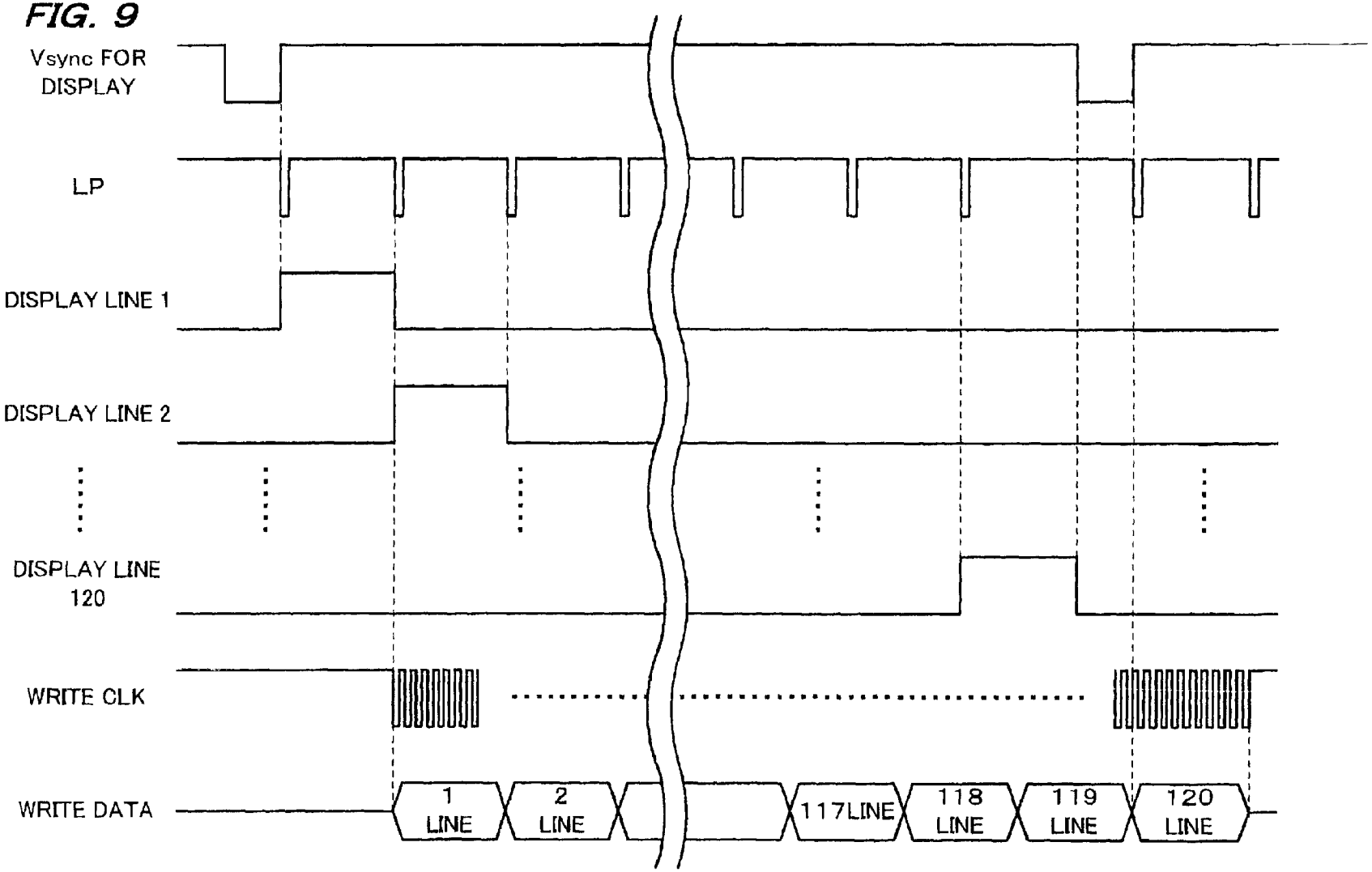
FIG. 9 is a timing chart showing write timing and read timing of the moving image data in the display controller in a modified example of the present invention.

FIG. 9 shows write timing and read timing of the moving image data in the display controller of this modified example.

Namely, the output of a latch pulse LP for scanning is started in a state in which an edge of the vertical synchronous signal Vsync for display outputted in one frame unit is set to a reference. The moving image data of one frame is sequentially read from a moving image memory area corresponding to the moving image display area 22A set in the display data RAM 160 every one scanning line.

On the other hand, the moving image data is sequentially written to the moving image memory area corresponding to the moving image display area 22A set in the display data RAM 160 every one scanning line in synchronization with a second latch pulse LP delayed by one scanning line among latch pulses LP for scanning outputted in synchronization with the edge of the vertical synchronous signal Vsync for display as a frame synchronous signal. Namely, after the read operation is precedently performed by one scanning line, the write operation is performed.

Thereafter, when the moving image data is written to the display data RAM 160, the display data RAM 160 is accessed in a similar relation with respect to the write timing and the read timing every one frame.

Here, when the reading speed $V_R'$ of the display data for one scanning line and the writing speed $V_W'$ of the display data for one scanning line is equal to each other, the relation of a reading rate $f_R'$ of the display data for one scanning line and a writing rate $f_W'$ of the display data for one scanning line is prescribed as in the following formula (4).

$$f_R' \geqq f_W' > f_{R0} \quad (4)$$

In the case of FIG. 3, the reading rate $f_R'$ corresponds to the frame frequency $f_0$ (=60 Hz). Further, $f_{R0}$ shows a minimum frame frequency at which the display data of the next frame begin to be read at a rate lower than this rate.

In the above explanation, the display controller in each of this embodiment and this modified example writes the moving image data of one frame to the moving image memory area corresponding to the moving image display area set in the built-in display data RAM 160, but the present invention is not limited to this case. For example, the display controller can similarly write the moving image data of one frame to the moving image memory area corresponding to the moving image display area with the entire memory area of the built-in display data RAM 160 as the moving image display area.

Further, in the above explanation, the RAM built in the display controller in each of this embodiment and this modified example is set to a three-port RAM, but the present invention is not limited to this case. The built-in RAM may be similarly set to a two-port RAM. In this case, it is necessary to perform complicated control in which e.g., still image data is written to the display data RAM while the moving image data of one frame and the moving image data of the next frame is written to the display data RAM.

Further, in the above explanation, the display controller in each of this embodiment and this modified example is set to the X-driver IC, but the present invention is not limited to this case. For example, the function of a Y-driver IC may be also built in the display controller as well as the function of the X-driver IC, and the X-driver IC and the Y-driver IC may be also formed as one chip.

Furthermore, the display controller in each of this embodiment and this modified example may be also constructed by separating the liquid crystal driving circuit requiring a high withstand voltage property into two chips.

The present invention is not limited to this embodiment and this modified example, but various kinds of modifications can be embodied within the scope of features of the present invention.

What is claimed is:

1. A display control method for displaying moving images and still images, the method comprising:

a step of preparing a memory which stores display data of at least one frame, a timing generation circuit generating a given display timing, and a display section driven based on the display data from the memory, wherein the display data includes moving image data and still image data and is generated at a rate lower than a rate of reading the display data from the memory;

a step of sequentially reading the display data including at least the moving image data for one scanning line from the memory based on the display timing from the timing generation circuit, and displaying at least moving images for at least three continuous frames onto the display section, each of the frames including the same image; and a step of writing the display data including at least the moving image data for one scanning line into the memory at a speed higher than a reading speed of the display data in synchronization with the display timing prior to the reading of the display data for one scanning line from the memory, wherein a physical disorder between the three continuous frames is minimized.

2. The display control method according to claim 1, wherein a write operation of the display data for one scanning line is performed precedently to a read operation of the display data for one scanning line by at least one scanning line.

3. The display control method according to claim 1, wherein after the display data for one scanning line to be controlled is written, the display data for the one scanning line is read.

4. The display control method according to claim 1, wherein after the display data for one frame is written at a given frame synchronous timing, writing of the display data is stopped until the next frame synchronous timing.

5. The display control method according to claim 1, wherein the display data written into the memory is inputted in synchronization with display timing generated by the timing generation circuit.

6. A display control method for displaying moving images and still images, the method comprising:

a step of preparing a memory which stores display data of at least one frame, a timing generation circuit generating a given display timing, and a display section driven based on the display data from the memory, wherein the display data includes moving image data and still image data and is generated at a rate lower than a rate of reading the display data from the memory;

a step of sequentially reading the display data including at least the moving image data for one scanning line from the memory based in the display timing from the timing generation circuit, and displaying at least moving images for at least three continuous frames onto the display section, each of the frames including the same image; and a step of reading the display data including at least the moving image data for one scanning line for displaying the display section from the memory at a speed higher than a writing speed of the display data in synchronization with the display timing prior to writing of the display data for one scanning line into the memory in synchronization with the display timing, wherein a physical disorder between the three continuous frames is minimized.

7. The display control method according to claim 6, wherein a read operation of the display data for one scanning line is performed precedently by at least one scanning line to a write operation of the display data for one scanning line.

8. The display control method according to claim 6, wherein after the display data for one scanning line to be controlled is read, the display data for the one scanning line is written.

9. The display control method according to claim 6, wherein the display data written into the memory is inputted in synchronization with display timing generated by the timing generation circuit.

10. A display controller for driving a display section based on display data for displaying moving images for at least three continuous frames, each of which has the same image, and including:

a timing generation circuit generating a given display timing;

a memory which stores the display data including moving image data for at least one frame, wherein the display data is generated at a rate lower than a rate of reading the display data from the memory;

a first control circuit which controls reading of the display data including the moving image data for one scanning line stored in the memory based on the display timing to display the display section; and a second control circuit which writes the display data including the moving image data for one scanning line inputted asynchronously with the display timing into the memory at a speed higher than a reading speed of the display data stored in the memory prior to a read operation, wherein a physical disorder between the three continuous frames is minimized.

11. The display controller according to claim 10, wherein a write operation of the display data for one scanning line controlled by the second control circuit is performed precedently by at least one scanning line to a read operation of the display data for one scanning line controlled by the first control circuit.

12. The display controller according to claim 10, wherein after the display data for one scanning line to be controlled is written by the second control circuit, the display data for the one scanning line is read by the first control circuit.

13. The display controller according to claim 10, wherein after the display data for one frame is written at a given frame synchronous timing, the second control circuit stops writing of the display data until the next frame synchronous timing.

14. The display controller according to claim 10, wherein a circuit for outputting the display timing is included.

15. A display unit for displaying moving images and still images, the display unit comprising:

a panel having an electro-optic element driven by a plurality of first electrodes and a plurality of second electrodes;

a display controller for driving the plurality of first electrodes based on display data for displaying at least moving images for at least three continuous frames, each of the frames including the same image; and a scanning driver scanning the plurality of second electrodes, wherein the display controller includes:

a timing generation circuit generating a given display timing;

a memory which stores the display data for at least one frame, wherein the display data includes moving image data and still image data and is generated at a rate lower than a rate of reading the display data from the memory;

a first control circuit which controls reading of the display data including at least the moving image data for one scanning line stored in the memory based on the display timing to display the display section; and a second control circuit which writes the display data including at least the moving image data for one scanning line inputted asynchronously with the display timing into the memory at a speed higher than a reading speed of the display data stored in the memory prior to a read operation, wherein a physical disorder between the three continuous frames is minimized.

16. An electronic device comprising:

a display unit as defined by claim 15; and a circuit for supplying the display data to the display unit.

17. A display controller for driving a display section based on display data for displaying moving images and still images for at least three continuous frames, each of which has the same image, and including:

a timing generation circuit generating a given display timing;

a memory which stores the display data including moving image data and still image data for at least one frame, wherein the display data is generated at a rate lower than a rate of reading the display data from the memory;

a write control circuit writing display data including moving image data and still image data asynchronously with the display timing into the memory; and a read control circuit which controls reading of the display data including moving image data and still image data for one scanning line stored to the memory at a speed higher than a writing speed of the display data for one scanning line into the memory prior to a write operation in the write control circuit in order to display the display section, wherein a physical disorder between the three continuous frames is minimized.

18. A display controller according to claim 17, wherein a read operation of the display data for one scanning line in the read control circuit is performed precedently by at least one scanning line to a write operation of the display data for one scanning line in the write control circuit.

19. A display controller according to claim 17, wherein after the display data for one scanning line to be controlled is read by the read control circuit, the display data for the one scanning line is written by the write control circuit.

20. A display controller according to claim 17, further comprising a circuit for outputting the display timing.

21. A display unit for displaying moving images, the display unit comprising:

a panel having an electro-optic element driven by a plurality of first electrodes and a plurality of second electrodes;

a display controller for driving the plurality of first electrodes based on display data for displaying moving images for at least three continuous frames, each of the frames including the same image; and a scanning driver scanning the plurality of second electrodes, wherein the display controller includes:

a timing generation circuit generating a given display timing;

a memory which stores the display data including moving image data for at least one frame, wherein the display data is generated at a rate lower than a rate of reading the display data from the memory;

a write control circuit which writes the display data including moving image data inputted asynchronously with the display timing into the memory; and a read control circuit which controls reading of the display data including moving image data for one scanning line stored in the memory at a speed higher than a writing speed of the display data for one scanning line into the memory prior to a write operation in the write control circuit to display the display section, wherein a physical disorder between the three continuous frames is minimized.

22. An electronic device including:

a display unit as defined by claim 21; and a circuit which supplies the display data to the display unit.

* * * * *